US009308463B2

(12) United States Patent
Bartels

(10) Patent No.: US 9,308,463 B2
(45) Date of Patent: Apr. 12, 2016

(54) SUCTION CUP TEETHER TOY

(71) Applicant: Ross E. Bartels, Chicago, IL (US)

(72) Inventor: Ross E. Bartels, Chicago, IL (US)

( * ) Notice: Subject to any disclaimer, the term of this patent is extended or adjusted under 35 U.S.C. 154(b) by 0 days.

(21) Appl. No.: 14/449,924

(22) Filed: Aug. 1, 2014

(65) Prior Publication Data

US 2016/0030853 A1 Feb. 4, 2016

(51) Int. Cl.
*A63H 33/00* (2006.01)
*A63H 33/04* (2006.01)

(52) U.S. Cl.
CPC ..... *A63H 33/04* (2013.01)

(58) Field of Classification Search
USPC ..... 446/71, 227; 248/346.11; 606/234, 235; D24/194
See application file for complete search history.

(56) References Cited

U.S. PATENT DOCUMENTS

| | | | | | |
|---|---|---|---|---|---|
| 718,517 | A | | 1/1903 | Perry | |
| 2,466,502 | A | * | 4/1949 | Stiller | 248/346.11 |
| 3,071,886 | A | | 1/1963 | Stiller | |
| 3,101,566 | A | * | 8/1963 | Stiller | 248/346.11 |
| 3,101,567 | A | | 8/1963 | Stiller | |
| D211,888 | S | | 8/1968 | Hall et al. | |
| 3,542,411 | A | | 11/1970 | Filas | |
| 3,654,047 | A | * | 4/1972 | Berkowitz | 428/179 |
| 3,677,951 | A | | 7/1972 | Alles | |
| 4,235,041 | A | * | 11/1980 | Sweet | 446/177 |
| 4,360,206 | A | * | 11/1982 | Bian | 273/348.2 |
| 4,569,349 | A | * | 2/1986 | McKee | 606/235 |
| 4,848,542 | A | * | 7/1989 | Burnette et al. | 206/765 |
| 5,066,018 | A | | 11/1991 | Hinton | |
| 5,165,462 | A | * | 11/1992 | Kang | 160/370.21 |
| 5,199,716 | A | * | 4/1993 | DeFluiter et al. | 473/572 |
| 6,527,616 | B1 | * | 3/2003 | Li | 446/267 |
| D640,383 | S | * | 6/2011 | Roehrig et al. | D24/194 |
| 8,021,391 | B2 | * | 9/2011 | Minoguchi et al. | 606/235 |
| D687,954 | S | * | 8/2013 | Dallman | D24/194 |
| 8,905,560 | B1 | * | 12/2014 | Zadro | 359/876 |
| 2005/0004603 | A1 | * | 1/2005 | Desousa et al. | 606/235 |
| 2009/0130944 | A1 | * | 5/2009 | Friedman et al. | 446/71 |
| 2009/0299410 | A1 | * | 12/2009 | Brabant et al. | 606/235 |
| 2011/0245870 | A1 | * | 10/2011 | McKinney | 606/235 |
| 2013/0112824 | A1 | | 5/2013 | Chen et al. | |
| 2014/0243895 | A1 | * | 8/2014 | Kellogg | 606/235 |

OTHER PUBLICATIONS

Bartels, Ross E., "Baby Teether/Bath Toy," presentation of similar materials on the market, received Apr. 29, 2014, 4 pages.
"pipSquigz," retrieved from https://fatbraintoys.com/toy_companies/fat_brain_toy_co/pipsquigz.cfm on Oct. 10, 2014, 3 pages.

* cited by examiner

*Primary Examiner* — Kurt Fernstrom
(74) *Attorney, Agent, or Firm* — Vedder Price PC

(57) ABSTRACT

The present invention relates to a new type of suction cup toy for children and associated methods of use thereof, and, more particularly, to a teether, a play toy, a construction toy, and/or a combination teether and toy.

19 Claims, 11 Drawing Sheets

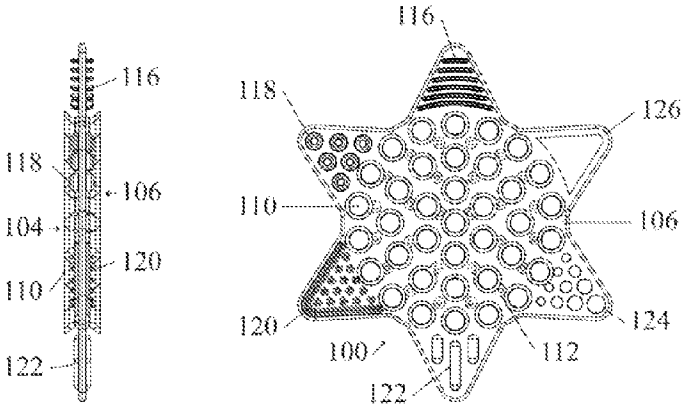
FIG. 3
FIG. 6
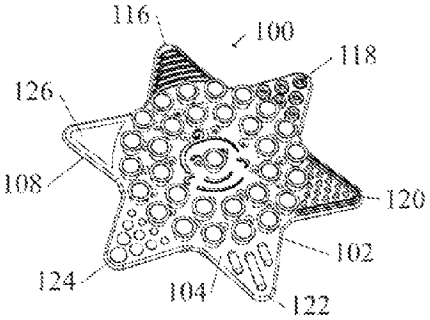
FIG. 1
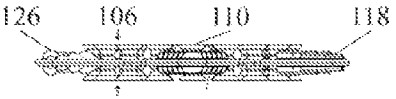
FIG. 4
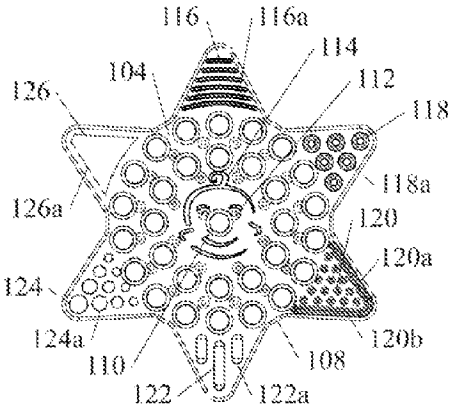
FIG. 2
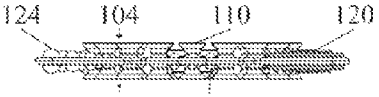
FIG. 5
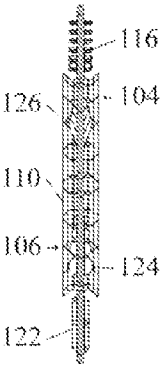
FIG. 7

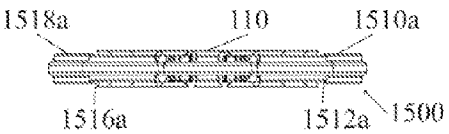
FIG. 18
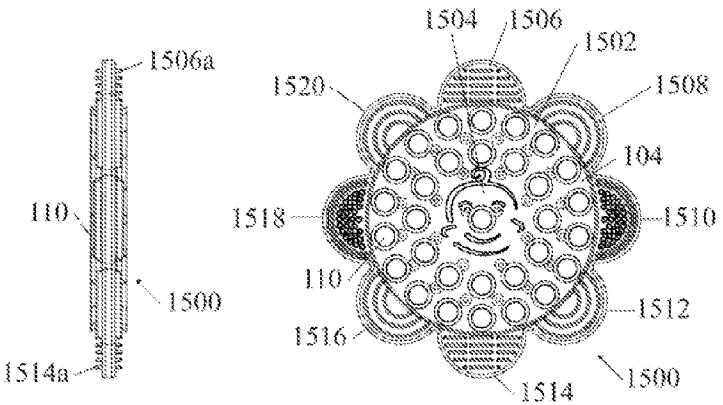
FIG. 16
FIG. 21
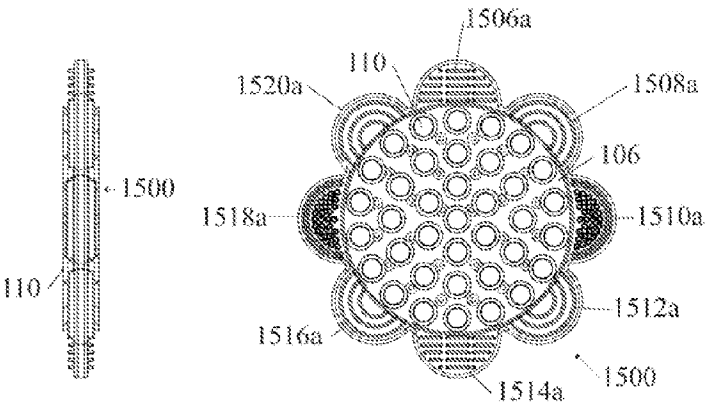
FIG. 17
FIG. 20
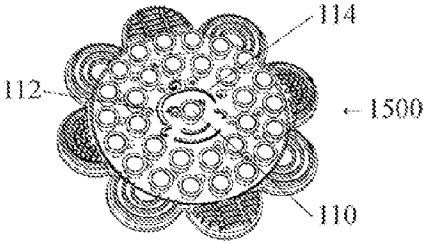
FIG. 15
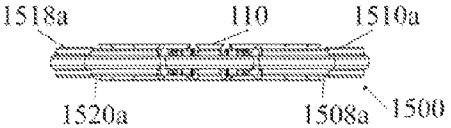
FIG. 19

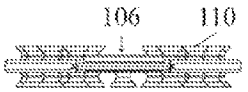
FIG. 46
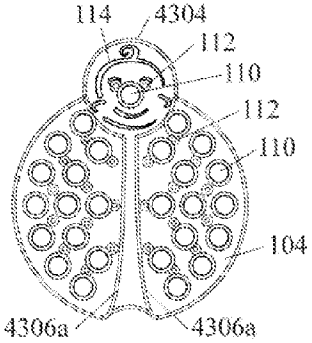
FIG. 44
FIG. 45
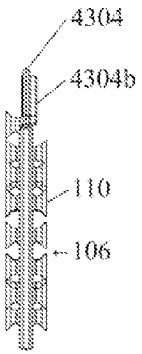
FIG. 48
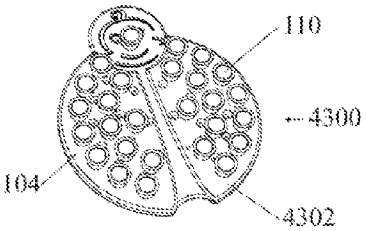
FIG. 43
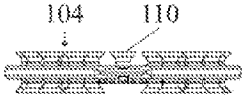
FIG. 47
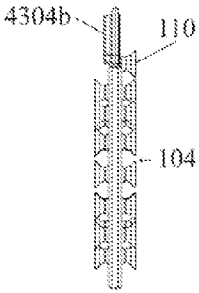
FIG. 49

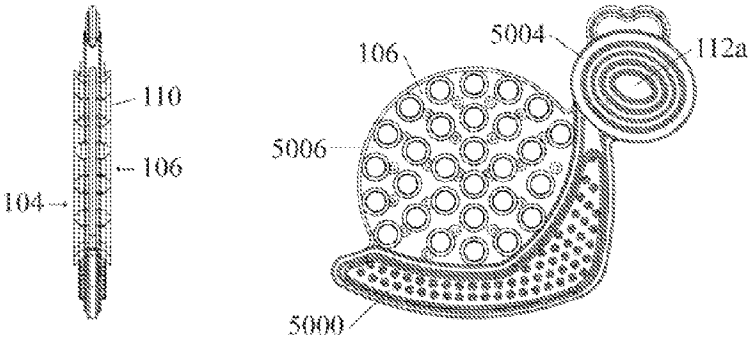
FIG. 52
FIG. 55
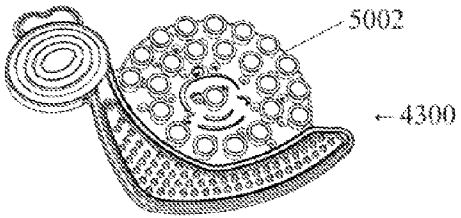
FIG. 50
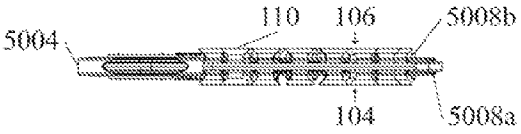
FIG. 53
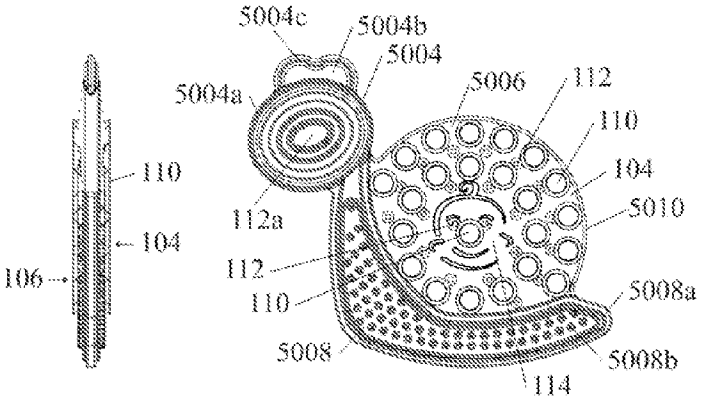
FIG. 51
FIG. 56
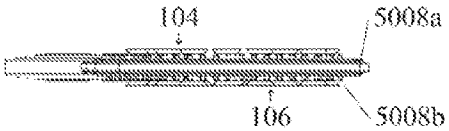
FIG. 54

SUCTION CUP TEETHER TOY

FIELD OF THE INVENTION

The present invention relates to a new type of suction cup toy for children and associated methods of use thereof, and, more particularly, a teether, a play toy, a construction toy, and/or a combination teether and toy.

BACKGROUND

Previously, suction cups have been used to secure items to surfaces for a variety of purposes. For example, U.S. Pat. No. 3,677,951 discloses a self-anchorable composite item using suction cups disposed on a single side thereof. Similarly, U.S. Pat. No. 3,101,567 discloses a vacuum cup holding device with suction cups disposed on opposite sides of the device. Devices such as these have been used, for example, to removably secure a bar of soap to a wall in a shower.

However, these devices are not designed for children to play with, and may pose a significant risk to a child. These devices may be made from toxic or other harmful components that could injure or poison a child if the devices were placed in a child's mouth or chewed on. These devices may pose a choking risk for a child, as they could become lodged in a child's mouth or throat and prevent the child from breathing. Further, the devices may be easily broken or torn apart and create a safety hazard, as a child may ingest pieces of the device. Finally, such devices are optimized so as to remain attached to a surface or an object for prolonged periods of time. Thus, a child may have difficulty removing these devices from a surface or object.

Teethers may provide many benefits to a teething child. Chewing on a teether applies pressure and pulls on the gums and teeth, which can both strengthen the gums and/or clean the teeth. This pressure may also relieve pain caused by teething and assist in the growth or development of a child's teeth. Further, the use of a teether may provide psychological benefits by giving the child an activity that exercises his or her mouth, thereby soothing the child.

A toy may also provide many benefits to a child. A toy may be used to entertain a child or provide the child with enjoyment. Further, toys may be educational, assisting a child in learning basic spatial-reasoning or more advanced skills such as language or math. Preferably, a toy should be interesting to a child and provide cognitive stimulation.

There exists a need for improved teethers and toys. In particular, such items may be used while a child is located on the floor, in a bath tub, in a high chair, or in another location where a surface is located nearby. Accordingly, there exists a need for toys and teethers that are configured to removably attach to various surfaces.

SUMMARY

In accordance with embodiments of the present invention, improved toys and teethers are provided. Such suction cup toys may include suction cups disposed on all or a portion of the surface of the toy to removably connect the toy to a nonporous surface. These suction cups may be adapted and arranged such that the force required to remove the toy varies based on which portion of the toy is attached to the surface. The toy may be adapted so that it is easier for a child to grab the toy and remove it from a surface. The toy may be a letter, number, animal, plant, character, geometric shape, organic form, logo, or any other shape that is entertaining and/or educational to a child.

An embodiment of the present invention provides a suction cup toy adapted to removably attach to a nonporous surface and adapted for easy removal from the surface once attached, the suction cup toy comprising:

- a substantially planar sheet comprising a flexible, chewable material having a front side, a back side opposite the front side, and a perimeter section;
- a first array of suction cups disposed on either of the front side or the back side, wherein each suction cup in the first array extends perpendicularly away from the sheet and is adapted to removably attach to the surface; and
- a means for holding the toy so as to detach the suction cups of the first array from the surface, wherein the means is selected from a group consisting of:
  - a lip on the perimeter surface of the planar sheet wherein the lip protrudes perpendicular to the sheet and extends a distance away from both the front side and the back side;
  - a first textured portion disposed on the back side with a first protrusion extending away from the back side and a second textured portion disposed on the front side opposite the first textured portion with a second protrusion extending away from the front side;
  - a passageway extending through the sheet from the back side to the front side, wherein the passageway is adapted to allow a child to grasp and place a lifting force on the toy; and
  - a portion of the first array wherein a distance between adjacent ones of the suction cups in the first array is increased so as to allow a child to insert one or more fingers between the adjacent ones of the suction cups.

An embodiment of the present invention provides a suction cup toy adapted to removably attach to a nonporous surface and adapted for easy removal from the surface once attached, the toy comprising:

- a tube comprised of a flexible, chewable material having a surface comprising a front section, a back section opposite the front section, an exterior section, and an interior section opposite the exterior section, wherein the front section and back section are substantially orthogonal to the exterior section and the interior section and the tube is toroidal;
- a first array of suction cups disposed on the back section, wherein each suction cup in the first array extends perpendicularly away from the back section and is adapted to removably attach to the surface;
- a second array of suction cups disposed on the front section, wherein each suction cup in the second array extends perpendicularly away from the front section and is adapted to removably attach to the surface; and
- a third array of suction cups disposed on the exterior section, wherein each suction cup in the third array extends perpendicularly away from the exterior section and is adapted to removably attach to the surface;
- wherein the suction cups in the first array are of substantially equivalent dimensions to the suction cups in the second array and the number of suction cups in the first array is greater than the number of suction cups in the second array, such that the force required to remove the first array from the surface is greater than the force required to remove the second array from the surface.

BRIEF DESCRIPTION OF THE DRAWINGS

Certain embodiments are shown in the drawings. However, it is understood that the present disclosure is not limited to the arrangements and instrumentality shown in the attached drawings.

FIG. 1 is a perspective view of an embodiment of the present invention;

FIG. 2 is a front view of the embodiment of FIG. 1;

FIG. 3 is a back view of the embodiment of FIG. 1;

FIG. 4 is a side view of the north edge of the embodiment of FIG. 1;

FIG. 5 is a side view of the south edge of the embodiment of FIG. 1;

FIG. 6 is a side view of the east edge of the embodiment of FIG. 1;

FIG. 7 is a side view of the west edge of the embodiment of FIG. 1;

FIG. 15 is a perspective view of a third embodiment of the present invention;

FIG. 16 is a front view of the embodiment of FIG. 15;

FIG. 17 is a back view of the embodiment of FIG. 15;

FIG. 18 is a side view of the north edge of the embodiment of FIG. 15;

FIG. 19 is a side view of the south edge of the embodiment of FIG. 15;

FIG. 20 is a side view of the east edge of the embodiment of FIG. 15;

FIG. 21 is a side view of the west edge of the embodiment of FIG. 15;

FIG. 43 is a perspective view of a seventh embodiment of the present invention;

FIG. 44 is a front view of the embodiment of FIG. 43;

FIG. 45 is a back view of the embodiment of FIG. 43;

FIG. 46 is a side view of the north edge of the embodiment of FIG. 43;

FIG. 47 is a side view of the south edge of the embodiment of FIG. 43;

FIG. 48 is a side view of the east edge of the embodiment of FIG. 43;

FIG. 49 is a side view of the west edge of the embodiment of FIG. 43;

FIG. 50 is a perspective view of an eighth embodiment of the present invention;

FIG. 51 is a front view of the embodiment of FIG. 50;

FIG. 52 is a back view of the embodiment of FIG. 50;

FIG. 53 is a side view of the north edge of the embodiment of FIG. 50;

FIG. 54 is a side view of the south edge of the embodiment of FIG. 50;

FIG. 55 is a side view of the east edge of the embodiment of FIG. 50;

FIG. 56 is a side view of the west edge of the embodiment of FIG. 50;

DETAILED DESCRIPTION

Figure 11:
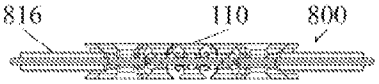
FIG. 11 is a side view of the north edge of the embodiment of FIG. 8.
Figure 9:
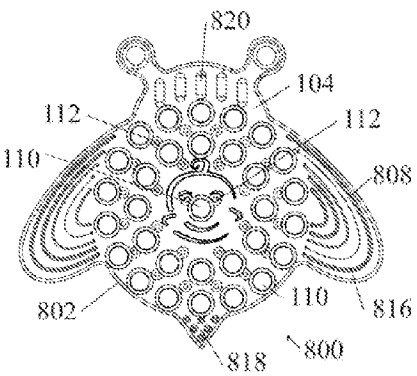
FIG. 9 is a front view of the embodiment of FIG. 8.
Figure 10:
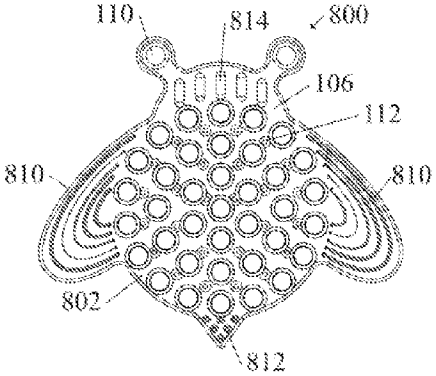
FIG. 10 is a back view of the embodiment of FIG. 8.
Figure 13:
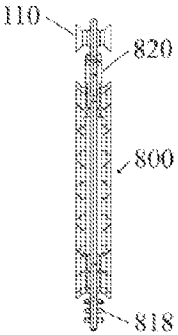
FIG. 13 is a side view of the east edge of the embodiment of FIG. 8.
Figure 14:
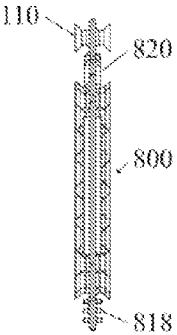
FIG. 14 is a side view of the west edge of the embodiment of FIG. 8.
Figure 12:
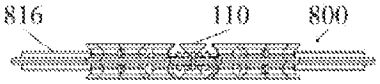
FIG. 12 is a side view of the south edge of the embodiment of FIG. 8.
Figure 8:
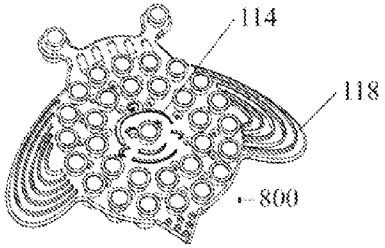
FIG. 8 is a perspective view of a second embodiment of the present invention.
Figure 25:
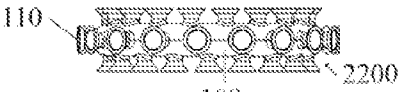
FIG. 25 is a side view of the north edge of the embodiment of FIG. 22.
Figure 23:
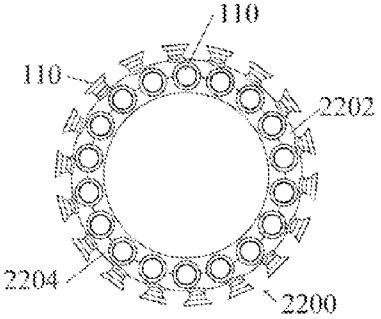
FIG. 23 is a front view of the embodiment of FIG. 22.
Figure 26:
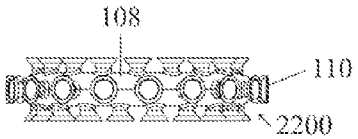
FIG. 26 is a side view of the south edge of the embodiment of FIG. 22.
Figure 28:
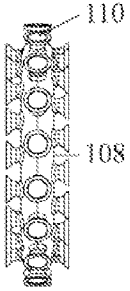
FIG. 28 is a side view of the west edge of the embodiment of FIG. 22.
Figure 27:
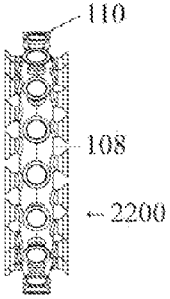
FIG. 27 is a side view of the east edge of the embodiment of FIG. 22.
Figure 24:
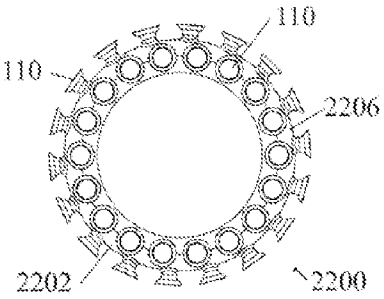
FIG. 24 is a back view of the embodiment of FIG. 22.
Figure 22:
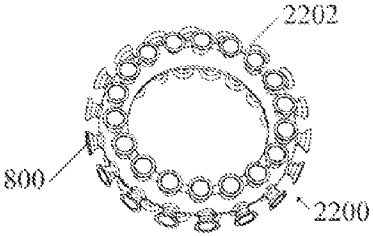
FIG. 22 is a perspective view of a fourth embodiment of the present invention.
Figure 32:
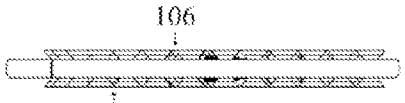
FIG. 32 is a side view of the north edge of the embodiment of FIG. 29.
Figure 31:
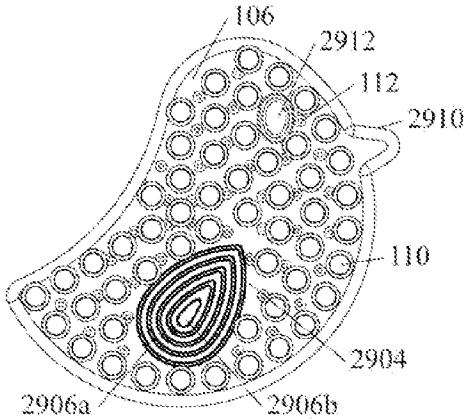
FIG. 31 is a back view of the embodiment of FIG. 29.
Figure 34:
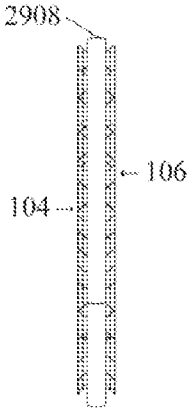
FIG. 34 is a side view of the east edge of the embodiment of FIG. 29.
Figure 29:
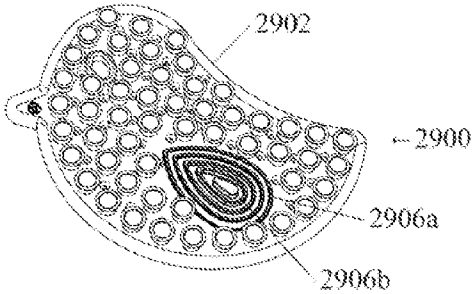
FIG. 29 is a perspective view of a fifth embodiment of the present invention.
Figure 30:
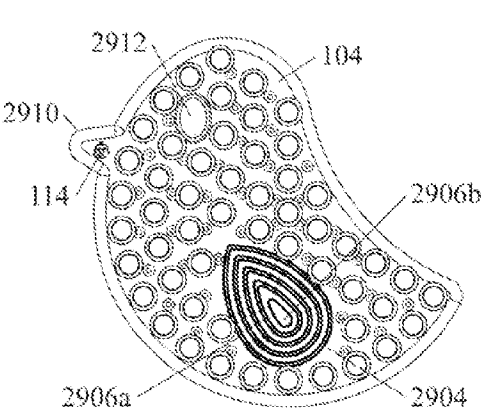
FIG. 30 is a front view of the embodiment of FIG. 29.
Figure 33:
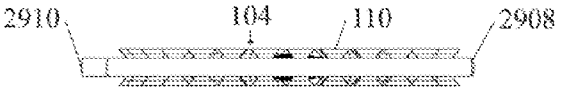
FIG. 33 is a side view of the south edge of the embodiment of FIG. 29.
Figure 35:
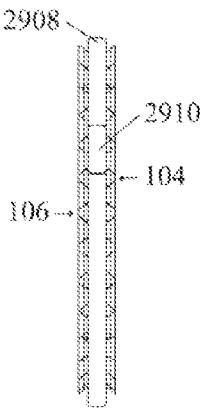
FIG. 35 is a side view of the west edge of the embodiment of FIG. 29.
Figure 39:
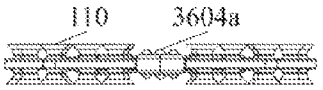
FIG. 39 is a side view of the north edge of the embodiment of FIG. 36.
Figure 37:
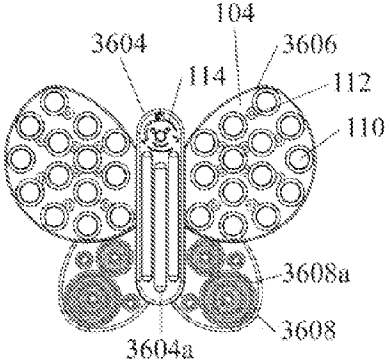
FIG. 37 is a front view of the embodiment of FIG. 36.
Figure 38:
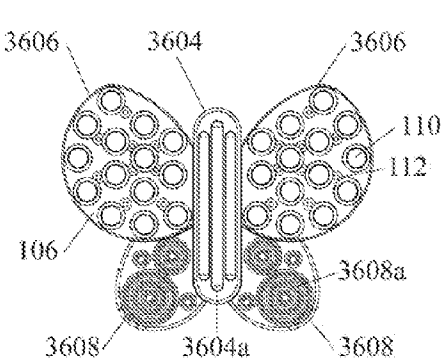
FIG. 38 is a back view of the embodiment of FIG. 36.
Figure 36:
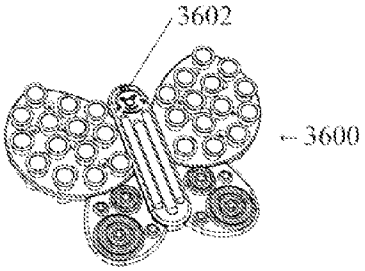
FIG. 36 is a perspective view of a sixth embodiment of the present invention.
Figure 41:
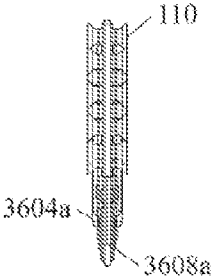
FIG. 41 is a side view of the east edge of the embodiment of FIG. 36.
Figure 40:
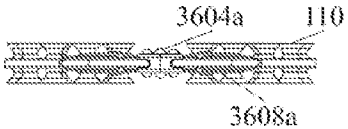
FIG. 40 is a side view of the south edge of the embodiment of FIG. 36.
Figure 42:
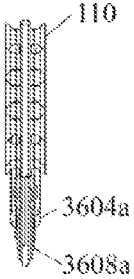
FIG. 42 is a side view of the west edge of the embodiment of FIG. 36.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one skilled in the art to which this disclosure relates.

Embodiments of the present invention provide teethers and toys that are chewable and have one or more suction cups disposed on one or more surfaces of the toy. Such items may be referred to as teethers, toys, or suction cup toys herein. Such a toy is capable of sticking to various surfaces, particularly nonporous smooth surfaces, including walls, tables, other toys, and the toy itself. Advantageously, such toys may provide a variety of different textures to increase a child's enjoyment from touching, manipulating, and chewing on the suction cup toy. Chewing on these textured portions applies pressure to the child's teeth or gums, soothing the child and assisting in the growth and development of the child's teeth and gums. The toys may be made in bright colors and interesting shapes to further increase a child's interest and enjoyment. For example, the body of the toy may be a first color while the suction cups may be a second color. The toy may create noise, for example, when a child detaches the suction cups from a surface. Such toys work to improve a child's physical development, particularly with regard to increased fine motor skills. Further, the toys may increase a child's cognitive development by teaching the children cause and effect. So as to ensure a child is able to easily use the toys, they may be adapted so that a child may easily grab and remove the toys from a surface.

FIGS. 1-7

FIGS. 1 through 7 depict a suction cup toy 100 in accordance with an embodiment of the present invention. FIG. 1 depicts a perspective view of the suction cup toy 100. As shown, the suction cup toy 100 may include a flat sheet 102 having a front side 104 and a back side 106. The sheet may be made of a soft, flexible material. In an embodiment, the material is chewable, resilient, and pliable. In an embodiment, the sheet 102 is made of medical grade silicone. Alternatively, the sheet 102 may be made from a flexible plastic, rubber, or any other suitable material. Preferably, the material is nontoxic and free from paints or coatings.

The perimeter 108 of the sheet 102 may be rounded. As will be clear to one of skill in the art, the perimeter 108 may be of any suitable geometric shape, including triangular, rectangular, cylindrical, and polyhedral. In an embodiment, the perimeter 108 may include a raised lip or protrusion that extends away from the sheet 102. The lip may extend away from the front side 104, the back side 106, or both. The lip may serve to make the sheet 102 easier for a child to grasp.

The sheet 102 may be in the form of an object. As shown, the sheet 102 is in the form of a six pointed star/sun, such as a hexagram with rounded points and intersections. As discussed herein, other shapes may also be used. These shapes may cause the toy to be more inviting to a child. Further, the shapes may make the toy educational. For example, toys may be made in basic geometric shapes such as circles, squares, and triangles to assist in teaching a child about shapes. Similarly, toys may be made in the shape of animals, numbers, letters, states, countries, puzzle pieces, or other objects, including as furniture, cars, planes, trains, and so forth. The toys may come in a variety of colors. In this way, the form or appearance of the toy can assist a child in learning basic skills such as language (e.g., the names of the various shapes, objects, and colors), mathematics, problem solving skills, and geometric or spatial relationships.

As shown in FIG. 2, the front side 104 may include one or more suction cups 110. In various embodiments, the suction cups 110 may be arranged in a geometric pattern, an organized pattern, or a random pattern. As shown, the suction cups 110 may be dispersed across a portion of the front side 104. For example, the suction cups 110 may cover only the central portion of the side 104 and may form a radial pattern. Alternatively, the suction cups may be arranged so as to cover the entirety of the side 104 or any desired portion of the side 104. As discussed herein, the suction cups 110 may be arranged in a variety of ways. For example, as shown, adjacent suction cups 110 may be equidistant from one another. Alternatively, the distance between adjacent suction cups 110 may vary according to a pattern or may be random.

Suction cups 110 may also be located on the back side 106 of the suction cup toy 100. The arrangement of suction cups 110 on the back side 106 may be identical to that on the front side 104. Alternatively, a different arrangement of suction cups 110 may be used on the back side 106 than on the front side. For example, the suction cups 110 on the back side 106 may be arranged so as to be offset from the suction cups 110 on the front side 104. Alternatively, the suction cups 110 on the back side 106 may be arranged in a first pattern (such as a random pattern), while the suction cups 110 on the front side 104 are arranged in a second pattern (such as a geometric pattern). Further, suction cups 110 may be disposed on only a single side 104 or 106 of the suction cup toy 100.

The suction cups 110 function to removably attach and detach the suction cup toy to a smooth, nonporous surface. The suction cups 110 are sized and spaced so as to require a predetermined amount of force to remove the suction cups from a surface. For example, the suction cups 110 may support a predetermined weight, such as the weight of the toy. Similarly, different arrangements and/or sizes of suction cups may be used to increase or decrease the force needed to remove the toy from a surface. In an embodiment, a first arrangement and/or size of suction cups is used on the front side 104 of the suction cup toy 100 while a second arrangement and/or size of suction cups is used on the back surface 106 of the suction cup toy 100. In this way, a first force will be needed to remove the suction cup toy 100 from a surface when it is attached using the front side 104 while a second and different force is required to remove the suction cup toy 100 while it is attached to a surface using the back side 106 of the toy. The suction cups may, for example, attach to a table, window, refrigerator, bath tub, wall, mirror, or other flat, nonporous surface. Further, the suction cups may attach to another portion of the device itself or to the surface of another device. For example, the suction cups on a first suction cup toy 100 may attach to the surface or suction cups of a second suction cup toy 100. Alternatively, the suction cups on a suction cup toy 100 may attach to the surface of another toy, including, but not limited to, a building block.

In addition to attaching the suction cup toy 100 to a surface, the suction cups 110 may be used to generate sound. Detaching a suction cup 110 from a surface may generate a noise as the seal between the suction cup 110 and the surface is broken. By changing the arrangement of suction cups 110 on the surface 102, the particular sounds generated by the suction cup toy 100 may be controlled. Further, by pulling the suction cup toy 100 away from the surface with different speeds or from different angles, a child playing with the toy 100 may generate a wide variety of entertaining sounds.

The front side 104 of the sheet 102 further includes one or more holes 112. The holes 112 extend through the sheet 102 from the front surface 104 to the back surface 106. The holes 112 may increase the safety of the suction cup toy 100. For example, the holes 112 decrease the risk that a child could suffocate while using the device by ensuring air can pass through the surface 102. Further, the holes 112 may increase the flexibility of the sheet 102. The holes 112 may be dispersed in a variety of patterns. For example, as shown, the holes 112 may be arranged so as to form a series of concentric circles, with adjacent holes 112 in each circle substantially equidistant from one another. The holes 112 may be located between and adjacent to the suction cups 110. Other arrangements will be clear to one of skill in the art.

In an embodiment, one or more of the holes 112 may be sized so as to accommodate connecting the suction cup toy 100 to another object, such as a high chair, stroller, crib, or other item. For example, a hole 112 may accommodate a strap or ring. Using the hole 112, the suction cup toy 100 may be removably joined to the other object, for example to a high chair, to ensure the suction cup toy 100 does not fall or is not lost while a child is playing with it. For example, a strap affixed to the high chair may pass through the hole 112. The holes 112 may be shaped as a circle, an oval, a square, or any other shape.

In an embodiment, one or more of the holes 112 may be sized so as to enable a child to easily grasp the toy 100 so as to remove the toy 100 from a surface. For example, one or more of the holes 112 may be sized to accommodate one or more of a child's fingers or a child's entire hand. Similarly, one or more of the front surface 104, the back surface 106, and the perimeter 108 may be adapted to enable a child to easily grab the toy 100. For example, the front surface 104 may include an area without suction cups 110 or with a lower density of suction cups 110 to provide an area for a child to grasp the toy 100. The perimeter 108 may include one or more protrusions or areas without suction cups 110 so as to enable the child to easily grab the toy 100. In an embodiment, the perimeter 108 includes a handle. The handle may be sized so as to accommodate a child's hand. In an embodiment, the handle protrudes from the perimeter and is substantially coplanar with the sheet 102. In another embodiment, the handle may protrude from either the front surface 104 or the back surface 106 and be substantially perpendicular to the sheet 102. As will be clear to one of skill in the art, the handle could protrude from any location on the sheet 102 and may form any suitable angle with the sheet.

The front surface 104 may include a design 114 such as a child's face or logo. The design 114 may incorporate at least one of the suction cups 110 and holes 112. For example, as shown the design 114 may use two of the holes 112 to depict the child's eyes and a suction cup 110 to depict the child's nose. Other designs may also be used and will be readily apparent to one of skill in the art. Alternatively, the design 114 may be located on the back surface 106 or on a protrusion from the sheet 102.

In an embodiment, the toy 100 includes a means for holding the toy 100 so as to detach the suction cups 110 from a surface. The means may be selected from a group consisting of: a lip on the perimeter surface of the planar sheet wherein the lip protrudes perpendicular to the sheet and extends a distance away from both the front side and the back side; a first textured portion disposed on the back side with a first protrusion extending away from the back side and a second textured portion disposed on the front side opposite the first textured portion with a second protrusion extending away from the front side; a passageway extending through the sheet from the back side to the front side, wherein the passageway is adapted to allow a child to grasp and place a lifting force on the toy; and a portion of an array of suction cups wherein a distance between adjacent ones of the suction cups in the array is increased so as to allow a child to insert one or more fingers between the adjacent ones of the suction cups. In an embodiment, the toy 100 may include a handle. This handle may be sized so as to accommodate a child's hand.

Portions of the surface 102 may be textured. For example, as shown, each of the points 116, 118, 120, 122, 124, 126 of the hexagram may include a texture. Each of the points 116, 118, 120, 122, 124, 126 may include a different type of texturing. This texturing may serve to provide a child with a variety of fun or soothing surfaces to chew on. For example, different texturing may serve to stimulate a child's gums while a child is teething. Other textures may be interesting for a child to manipulate with his or her fingers. By using a variety of different textures, a child's interest in and enjoyment from the suction cup toy 100 may be increased. Additionally, these textures may enable the child to more easily grab and tug on the toy 100, for example to remove the toy from a surface. With reference to FIGS. 1 through 7, one possible arrangement of texture will now be discussed.

As shown, the north point 116 includes a number of spaced-apart ridges 116*a* running laterally across the point 116 and extending perpendicular to the surface 102. These ridges 116*a* may be curved. In an embodiment, the ridges 116*a* are curved so as to form portions of the circumferences of a series of concentric circles. Further, the ridges 116*a* further from the center of the surface 102 may be shorter than the ridges 116*a* closer to the center of the surface 102. Alternatively, as will be clear to one of skill in the art, the ridges 116*a* may be in another geometric arrangement. For example, the ridges 116*a* may be straight lines running laterally, longitudinally, or in any other direction across the point 116. In an embodiment, each ridge is shaped as a rectangular prism. Alternatively, the central portion of each ridge may be shaped as a rectangular prism, while the terminal portions of each ridge may slope down to meet the surface 102 at the perimeter 108 of the surface 102.

As shown, the northeast point 118 may include a series of cylinders 118*a* which extend from the point 118 perpendicular to the surface 102. The cylinders 118*a* may be arranged in a series of lines running laterally across the point 118, with the number of cylinders 118*a* in each line decreasing farther from the center of the surface 102. In an embodiment, each cylinder 118*a* is hollow. Alternatively, each cylinder 118*a* may be solid. As shown, each cylinder 118*a* includes a lip running around the circumference of the portion of the cylinder 118*a* farthest from the surface 102, such that the lip has a greater diameter than the rest of the cylinder. Alternatively, the exterior surface of each cylinder may be of a substantially constant diameter.

In an embodiment, the cylinders 118*a* near the center of the surface 102 may extend further away from the surface 102 (that is, have a greater height) than the cylinders 118*a* near the perimeter 108 of the surface 102. Alternatively, the cylinders 118*a* near the perimeter 108 may extend further from the surface 102 than the cylinders 118*a* near the center of the surface 102. In an embodiment, the cylinders 118*a* in each line running laterally across the point 118 extends an equal distance away from the surface 102, with each successive line that is closer to the perimeter 108 extending a successively lesser distance away from the surface 102. Alternatively, each successive line that is closer to the perimeter 108 may extend a successively greater distance away from the surface 102.

As shown, the southeast point 120 includes a ridge 120*a* protruding perpendicular to the surface 102 around the edge of the point 120. The central portion of the point includes a series of protrusions 120*b* that may be arranged in a series of lines running laterally across the point 120, with the number of protrusions 120*b* in each line decreasing farther from the center of the surface 102. Additionally, the lines may be curved such that each line forms a portion of a circumference of one of a plurality of concentric circles. Each protrusion 120*b* may be a solid cylinder. Alternatively, others shapes may also be used.

As shown, the south point 122 includes a series of ridges 122*a* protruding perpendicular to the surface 102. The ridges

122*a* may run substantially longitudinally along the point 122. Each ridge 122*a* may be in the form of a horizontal cylindrical segment with half-hemispherical ends.

As shown, the southwest point 124 includes a series of projections 124*a* protruding perpendicular to the surface 102. Each projection 124*a* may be a hemisphere. The projections 124*a* may be arranged in lines running laterally across the point 124. The projections 124*a* may be of varying sizes. For example, the projections 124*a* closest to the perimeter 108 of the surface 102 may be larger than those farther from the perimeter 108 of the surface 102.

As shown, the northwest point 126 may include a series of ridges 126*a* protruding perpendicular to the surface 102. The series of ridges 126*a* may extend laterally across the point 126. Further, the ridges 126*a* may be rounded and of varying sizes. When viewed cross-sectionally, the ridges 126*a* may be shaped as overlapping parabolic curves, with the curves closer to the perimeter 108 of the point 126 smaller than those farther from the perimeter 108 of the point 126.

FIGS. 8-14

FIGS. 8 through 14 depict a suction cup toy 800 in accordance with a second embodiment of the present invention. As shown, the suction cup toy 800 may comprise a sheet 802 in the shape of an insect, such as a bee. As shown, the front surface 104 may include a design 114 such as a child's face or a logo. The design 114 may incorporate at least one of the suction cups 110 and holes 112. For example, as shown the design 114 may use two of the holes 112 to depict the child's eyes and a suction cup 110 to depict the child's nose. Other designs may also be used and will be readily apparent to one of skill in the art. Suction cups 110 may be arranged across both a front side 104 and a back side 106 of the sheet 802. The sheet 802 may include one or more textured portions 808. These textured portions may form the insect's wings 810, stinger 812, head 814, or other portions of the insect's body. For example, a series of curved ridges 816 may form the details on each of the wings 810. One or more protrusions 818 may form the texture on the stinger 812. A series of ridges 820 may form the texture on the head 814. Other textures or arrangements of textures may also be used.

FIGS. 15-21

FIGS. 15 through 21 depict a suction cup toy 1500 in accordance with a third embodiment of the present invention. As shown, the suction cup toy 1500 may comprise a sheet 1502 in the shape of a flower. Suction cups 110 may be arranged across both a front side 104 and a back side 106 of the sheet 1502. The suction cups on the front side 104 may be arranged in a series of concentric circles around a circular area devoid of suction cups 110. The circular area may include a design 114. The design 114 may be textured. As discussed above, the design may incorporate one or more holes 112, suction cups 110, or textured areas. Alternatively, this circular area may be left smooth. The different number and asymmetrical arrangement of suction cups 110 between the front side 104 and the back side 106 of the sheet 1502 causes the suction cup toy 1500 to require different amounts of force to remove the suction cup toy 1500 from a surface, depending on which of sides 104, 106 is attached to the surface.

The sheet 1502 may include a central portion 1504 surrounded by one or more petals 1506, 1508, 1510, 1512, 1514, 1516, 1518, 1520. Each of the petals 1506, 1508, 1510, 1512, 1514, 1516, 1518, 1520 may include one or more textured portions 1506*a*, 1508*a*, 1510*a*, 1512*a*, 1514*a*, 1516*a*, 1518*a*, 1520*a*. The same texture may be used on more than one of the petals. For example, the north petal 1506 and south petal 1514 may each contain a series of lateral ridges 1506*a*, 1514*a*. The east petal 1510 and west petal 1518 may contain a series of protrusions 1510*a*, 1518*a* arranged in a series of concentric rings. The northeast petal 1508, southeast petal 1512, southwest petal 1516 and northwest petal 1520 may each contain a series of ridges 1508*a*, 1512*a*, 1516*a*, 1520*a* arranged in concentric semicircles. Other textures and arrangements of textures may also be used.

FIGS. 22-28

FIGS. 22 through 28 depict a suction cup toy 2200 in accordance with a fourth embodiment of the present invention. As shown, the suction cup toy 2200 may comprise a tube 2202 in the form of a ring or a toroid. A front portion 2204 may include a plurality of suction cups 110. The suction cups 110 may be equidistantly spaced in a ring pattern along the front portion 2204 of the tube 2202. Similarly, suction cups 110 may be arranged in a second ring along a back portion 2206 of the tube 2202. The suction cups 110 on the back portion 2206 may be offset from the suction cups 110 on the front portion 2204, such that each suction cup 110 on the front portion 2204 is opposite a gap between suction cups 110 on the back portion 106 and vice versa. Alternatively, in an embodiment, the suction cups 110 on the back portion 106 may be in-line with the suction cups 110 on the front portion 104, such that there are an equal number of symmetrically arranged suction cups 110 on the back portion 106 and the front portion 104.

The exterior portion 108 may contain a plurality of suction cups 110 arranged axially thereon. In this way, suction cups 110 may be located in two or more different axes. The remainder of the surface of the tube 2202 may be smooth or textured. This arrangement of suction cups 110 arranged on two or more different axes may be incorporated into other shapes of suction cup toys. For example, the suction cup toy could be configured as a sphere or other three dimensional shape with suction cups 110 disposed on any number of the toy's surfaces in and oriented in any number of axes. Similarly, the other embodiments of suction cup toys discussed herein may be modified to include suction cups 110 on two or more different axes. For example, the suction cup toy 100 shown in FIG. 1 may be modified to include suction cups 110 on a second axis by placing suction cups along the perimeter 108 of the sheet. Further, suction cups 110 may be disposed on a protrusion extending away from the sheet 102, such that the suction cups 110 may be oriented in any desired axis.

FIGS. 29-35

FIGS. 29 through 35 depict a suction cup toy 2900 in accordance with a fifth embodiment of the present invention. As shown, the suction cup toy 2900 may comprise a sheet 2902 in the shape of a bird. Suction cups 110 may be arranged across both a front side 104 and a back side 106 of the sheet 2902. The suction cups on the front side 104 may be arranged around an area 2904 devoid of suction cups 110. The area 2904 may include a design forming the wings of the bird. The design may be textured. As shown, the design may include a series of concentric ridges 2906*a* protruding away from the surface 2902 surrounding a raised central protrusion 2906*b*. Alternatively, this area 2904 may be left smooth. Additional textured areas or types of texturing may also be included on the sheet 2902.

The sheet 2902 may include a raised lip 2908 at the perimeter of the sheet 2902 protruding away from the front side 104, the back side 106, or both. The sheet may include a protrusion 2910 that is co-planar with the sheet 2902 forming the bird's beak. Other protrusions may form additional aspects of the bird, such as its feet, tail, or feathers. One or more holes 112 may be located on the sheet. Additionally, one or more larger holes 2912 may form features on the bird, such as the bird's eyes. The sheet 2902 may also include a design 114, such as a child's face or logo. The design 114 may be located, for example, on the protrusion 2910 forming the bird's beak.

FIGS. 36-42

FIGS. 36 through 42 depict a suction cup toy 3600 in accordance with a sixth embodiment of the present invention. As shown, the suction cup toy 3600 may comprise a sheet 3602 in the shape of a butterfly. The sheet 3602 may comprise a central portion 3604 forming the butterfly's body, protrusions 3606 forming the butterfly's top wings, and protrusions 3608 forming the butterfly's bottom wings.

The front side 104 and the back side 106 of the central portion 3604 may include a design 114 and/or texturing. As shown, the front side 104 of the central portion 3604 may include a design 114 and texturing. The design 114 may be a child's face, a logo, or the butterfly's face. As shown, the texturing may be in the form of a number of spaced-apart ridges 3604*a* running longitudinally across the central portion 3604 and extending perpendicular to the surface 3602. In an embodiment, the central portion of each ridge 3604*a* may be shaped as a rectangular prism, while the terminal portions of each ridge may slope down to meet the surface 3602. The ridges 3604*a* on the front side 104 may stretch from the end of the design 114 to the end of the central portion. As shown, the ridges 3604*a* on the back side 106 may stretch the length of the central portion 3604.

Alternatively, the central portion 3604 may contain one or more suction cups 110 and/or holes 112.

The top wings 3606 may include suction cups 110 arranged across a front side 104, a back side 106, or both the front side 104 and the back side 106 of the sheet 3602. The front wings may include a number of holes 112 extending from the front side 104 to the back side 106 of the sheet 3602. Alternatively, the top wings 3606 may include one or more protrusions or other form of texturing.

The bottom wings 3608 may include texturing. This texturing may be in the form of one or more sets of ridges 3608*a* forming concentric rings. Alternatively, the bottom wings 3608 may contain one or more suction cups 110 and/or holes 112.

The sheet 3602 may include a raised lip 3608 at the perimeter of each of the central portion 3604, top wings 3606, and bottom wings 3608 protruding away from the front side 104, the back side 106, or both. In an embodiment, protrusions may form additional aspects of the butterfly, such as its antenna.

FIGS. 43-49

FIGS. 43 through 49 depict a suction cup toy 4300 in accordance with a seventh embodiment of the present invention. As shown, the suction cup toy 4300 may comprise a sheet 4302 in the shape of a ladybug. The sheet 4302 may comprise a protrusion forming a head 4304 of the ladybug and sections forming wings 4306 of the ladybug.

The front side 104 and the back side 106 of the protrusion 4304 may include a design 114, texturing, suction cups 110, and/or holes 112. As shown, the front side 104 includes a design 114 and a single suction cup 110. The design 114 may be a child's face, a logo, or the ladybug's face. As shown, the design 114 is a child's face with the suction cup 110 forming the child's nose and holes 112 forming the child's eyes. As shown, the back side 106 includes texturing in the form of a ridge 4304*b* protruding perpendicular to the surface 4302 around the edge of the head 4304. The central portion of the head 4604 includes a series of protrusions 4304*a* that may be arranged in a series of semicircles running around the head 4304, with the number of protrusions 4304*a* in each semicircle increasing farther from the center of the head 4304. Each protrusion 4304*a* may be a solid cylinder. Alternatively, others shapes may also be used. The protrusions 4304*a* may be arranged to include gaps for holes 112.

Each wing 4306 may include one or more suction cups 110 and/or holes 112. Each wing 4306 may be raised perpendicular with respect to the head 4304 and the remainder of the sheet 4302 such that a ridge 4306*a* is formed between each wing 4306*a* and the sheet 4302. These ridges 4306*a* may take the form of a beveled edge. Similarly, the perimeter edge of the sheet 4302 may also be beveled.

In an embodiment, protrusions may form additional aspects of the ladybug, such as its antenna.

FIGS. 50-56

FIGS. 50 through 56 depict a suction cup toy 5000 in accordance with an eighth embodiment of the present invention. As shown, the suction cup toy 5000 may comprise a sheet 5002 in the shape of a snail. The sheet 5002 may comprise a protrusion forming a head 5004 of the snail, a section forming the shell 5006 of the snail, and a section forming the body 5008 of the snail.

The front side 104 and the back side 106 of the sheet 5002 may include a design 114, texturing, suction cups 110, and/or holes 112. As shown, the head includes a hole 112*a* and a series of raised ridges 5004*a*. The location of the hole 112*a* on the head enables a child to easily grasp and pull on the sheet 5002. These ridges 5004*a* may be arranged as a series of concentric rings. These ridges 5004*a* may further serve to increase the ability of a child to grab the sheet 5002. The head further may include a protrusion area representing, for example, the snail's eyestalks. This protruding section may comprise a flat section 5004*b* surrounded by one or more indentions 5004*c* along the edge of the sheet. The combination of the flat section 5004*b* with the indentations 5004*c* may enable a child to more easily insert his or her fingers under the sheet 5002 and detach the sheet 5002 from a surface.

The shell 5006 may include one or more suction cups 110 and holes 112. The front side 104 may include a design 114. Alternatively, the shell 5006 may include a textured portion or a smooth portion. The body 5008 may include one or more forms of texture. As shown, the body includes a raised ridge 5008*a* around the edge of the body 5008. The central portion of the body may contain a plurality of protrusions 5008*b*. Each protrusion 5008*b* may be a solid cylinder. Alternatively, others shapes may also be used. The protrusions 5008*b* may be surrounded by a raised ridge 5008*a* that extends around the perimeter of the body 5008. The ridge 5008*a* may extend substantially perpendicular to the sheet 5002. The front side 104 and back side 106 of the sheet 5002 may be arranged symmetrically. Alternatively, the front side 104 and back side 106 may contain different arrangements of elements or different elements entirely.

In an embodiment, additional protrusions may form additional aspects of the snail.

FIGS. 57-62

FIGS. 57 through 62 depict arrangements of suction cups 110 on planes of different shapes. For example, various arrangements may be preferred based on the size and shape of the sheet to be covered. Depicted are exemplary arrangements based on several possible shapes. As will be clear to one of skill in the art, other possible arrangements of suction cups 110 may also be desirable depending on, for example, the size and shape of the sheet, the size of the suction cups, the density of suction cups needed to support the weight of the toy or exert a desired force upon a surface, and the presence of holes, designs, textured areas, or other features on the surface of the toy. For example, by increasing the density of suction cups 110 on a sheet or the size of the suction cups 110, a greater force will be exerted between the sheet 102 and another surface when the suction cups 110 are attached to the other surface.

Figure 57:
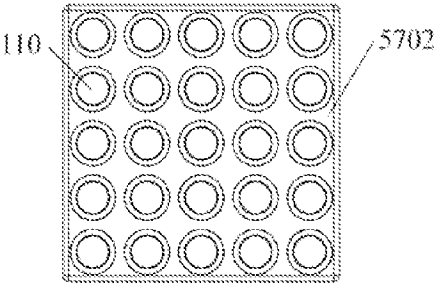
FIG. 57 depicts an arrangement of suction cups on a square plane.

As shown in FIG. 57, a square array of suction cups 110, with each suction cup 110 located equidistant from the adjacent suction cups in the same row or column, may be used to optimally cover a square sheet 5702. An equal number of suction cups may be placed in each row and column.

Figure 58:
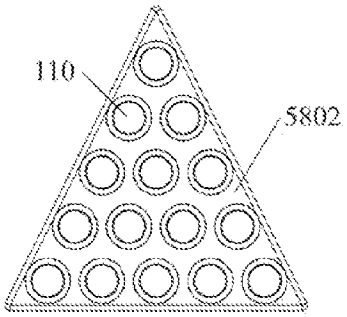
FIG. 58 depicts an arrangement of suction cups on a triangular plane.

As shown in FIG. 58, a triangular array of suction cups 110 may be used to optimally cover a triangular sheet 5802. The distance between each row of suction cups 110 may be equivalent to the distance between adjacent suction cups 110 in each row.

Figure 59:
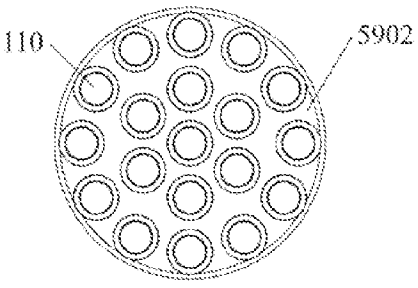
FIG. 59 depicts an arrangement of suction cups on a circular plane.

As shown in FIG. 59, suction cups 110 may be arranged in a series of concentric rings to optimally cover a circular surface 5902. A single suction cup 110 may be placed at the center of the sheet 3102. As shown, adjacent suction cups 110 in each ring may be equidistant from one another. Similarly, suction cups that are radially adjacent may be equidistant from one another.

Figure 60:
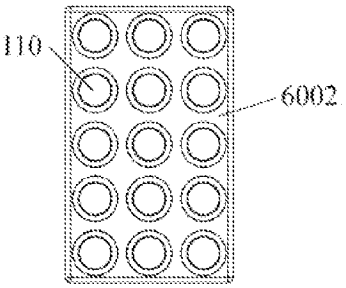
FIG. 60 depicts an arrangement of suction cups on a rectangular plane.

As shown in FIG. 60, a rectangular array of suction cups 110, with each suction cup 110 located equidistant from the adjacent suction cups in the same row or column, may be used to optimally cover a rectangular sheet 6002. An equal number of suction cups may be placed in each row. Similarly, each column may contain the same number of suction cups. The number of rows and columns used may depend on the size of the sheet 3202 so as to obtain the desired coverage of the sheet.

Figure 61:
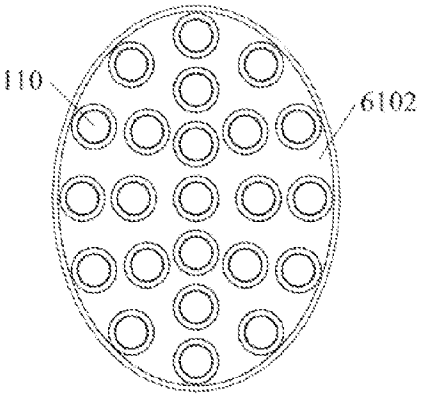
FIG. 61 depicts an arrangement of suction cups on an elliptical plane.

As shown in FIG. 61, suction cups 110 may be arranged in a series of concentric ellipses to optimally cover an elliptical sheet 6102. A single suction cup 110 may be placed at the center of the sheet 6102. As shown, adjacent suction cups 110 in each ring may be equidistant from one another. Similarly, suction cups that are radially adjacent may be equidistant from one another.

Figure 62:
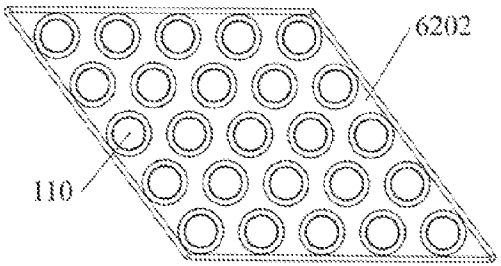
FIG. 62 depicts an arrangement of suction cups on a rhomboid plane.

As shown in FIG. 62, suction cups 110 may be arranged in two triangular arrays to optimally cover a rhomboid sheet 6202. The distance between each row of suction cups 110 may be equivalent to the distance between adjacent suction cups 110 in each row.

FIGS. 63-65

Figure 63:
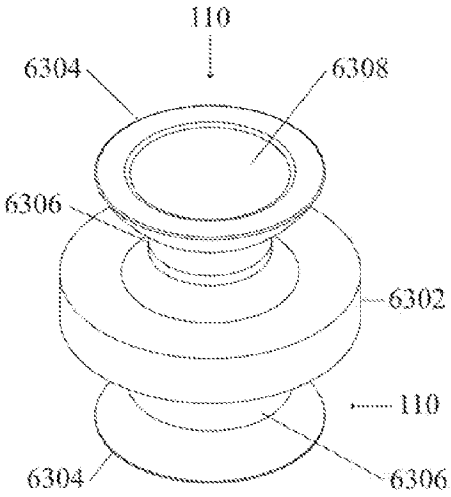
FIG. 63 is a perspective view of a suction cup on a sheet.
Figure 64:
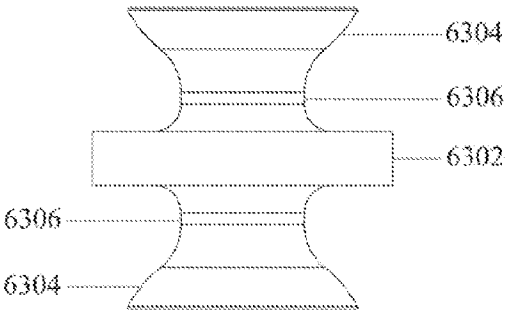
FIG. 64 is a cross-section view of the suction cup of FIG. 63.
Figure 65:
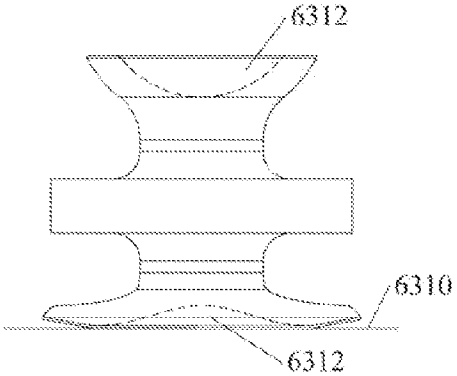
FIG. 65 is a cross-section view of the suction cup of FIG. 63 attached to a surface.

With reference to FIGS. 63 through 65, in an embodiment, each suction cup 110 may contain a head 6304 located on a body 6306. In an embodiment, each head 6304 is circular when viewed perpendicularly while each body 6306 is cylindrical and protrudes perpendicular to the sheet 6302. The interior face 6308 of each head 6304 may be curved. The suction cups 110 may be made from an elastic material. As a suction cup 110 is pressed against a surface 6310, the volume of space 6312 between the interior surface 6308 of the head 6304 and the surface 6310 decreases as the head 6304 deforms. Fluid, such as air or water, is expelled from this volume 6312. Once the suction cup 110 is no longer pressed against the surface 6310, the elastic material of the suction cup 110 attempts to regain its original shape. Due to the lower pressure in the volume 6312, the suction cup 110 adheres to the surface.

The force exerted by each suction cup depends on the size of the suction cup, or more specifically, on the area of the suction cup. By increasing the suction cup's size, great force can be exerted on a surface. Additionally, the force depends on the difference between the pressure inside the cup and the pressure outside the cup. By decreasing the amount of air that is able to leak in to the suction cup during use, greater force will be exerted on the surface.

Alternatively, in an embodiment, each suction cup 110 may comprise a head 6304 attached directly to the sheet 6302. In other words, the body 6306 may be omitted. This may decrease the likelihood that a suction cup 110 will become separated from or break off of the sheet.

In order to exert the greatest possible force against a surface 6310, it is necessary to optimally cover the sheet 102 with suction cups. One optimal configuration is to put as little distance between suction cups 110 as possible. If the heads 6304 of adjacent suction cups 110 touch or press against one another, one or both of the suction cups 110 may be unable to properly seal against a surface 6310. Accordingly, for suction cups that do not deform laterally, the spacing between adjacent bases 6306 must be equal to just over twice the difference in the radius of the base 6306 and the radius of the head 6304 if the suction cups 110 are identically-sized. Alternatively, if the heads 6304 are directly attached to the sheet 6302, the distance between the portion of adjacent heads 6304 that attaches to the sheet 6302 must be equal to just over twice the different between the radius of the head 6304 at the head's widest point and the radius of the head 6304 at the point where the head attaches to the sheet 6302. For suction cups that deform laterally when pressed against a surface, the space between adjacent bases should be increased by twice the difference between the radius of a deformed suction cup and the radius of the suction cup at rest.

FIG. 66

Figure 66:
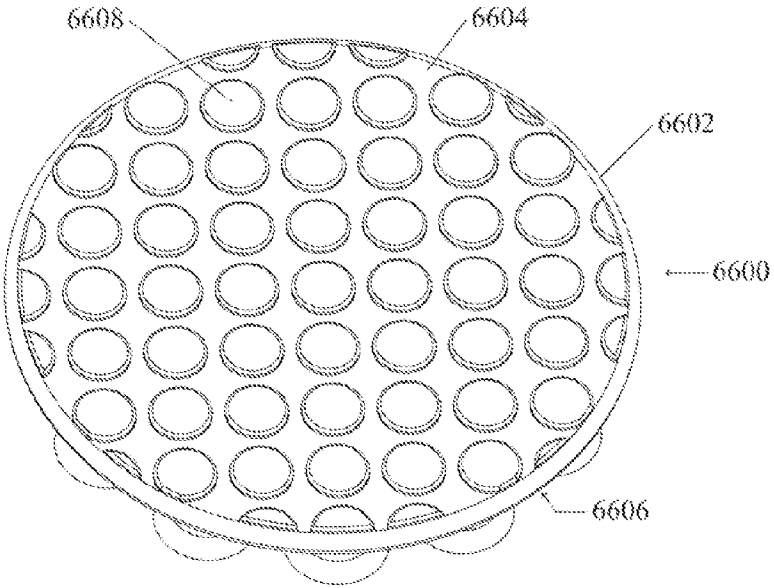
FIG. 66 is a perspective view of an embodiment of the present invention with texture on one surface and suction cups on an opposite surface.

FIG. 66 depicts another embodiment of the present invention. As shown, a suction cup toy 6600 may include a sheet 6602 with a front side 6604 and a back side 6606. The front side may include a textured pattern. For example, the front side 6604 may include a series of protrusions 6608 arranged in a grid pattern. Each protrusion 6608 may include a cylinder with a beveled edge, such that the diameter of the cylinder decreases further from the sheet 6602. In an embodiment, this textured pattern covers the entire face of the front side 6604, such that partial protrusions 6608*a* (not shown) are arranged along the perimeter of the front side 6604.

A design may be located on the front surface 6604. The design may incorporate the protrusions 6608 of the textured pattern into the design. The texture may serve to visually or mechanically stimulate a child. For example, the design may be visually interesting such that a child is motivated to look at or handle the suction cup toy 6600. Similarly, the texture may be physically or mechanically stimulating such that a child is motivated to touch or chew on the suction cup toy 6600.

In contrast, the back side 6606 may contain one or more suction cups 110. As discussed herein, the suction cups 110 may be arranged in any suitable pattern.

FIG. 67

Figure 67:
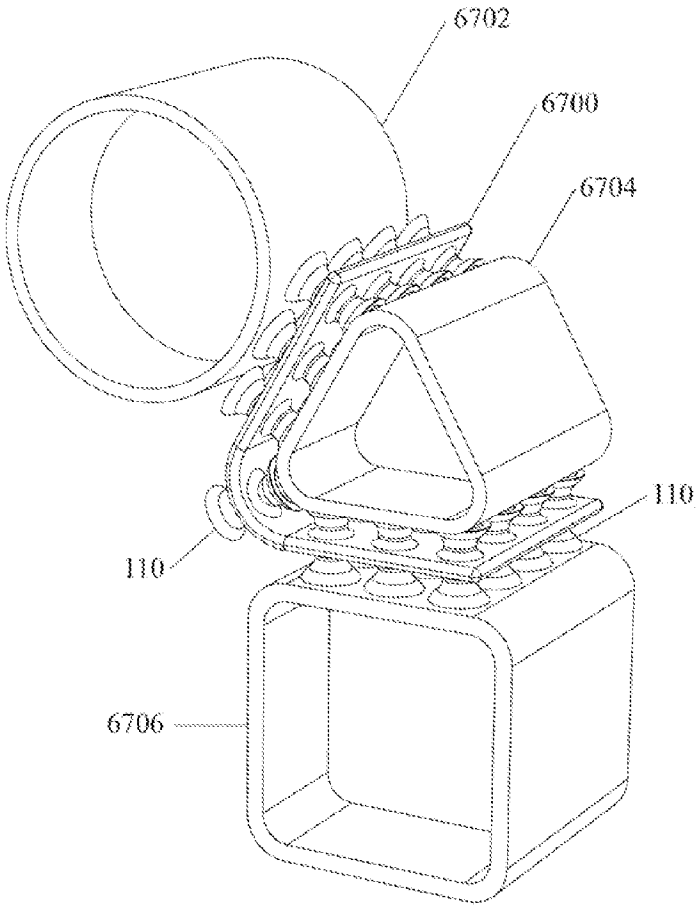
FIG. 67 is a perspective view of an embodiment of the present invention used as a construction toy.

As shown in FIG. 67, a suction cup toy 6700 in accordance with an embodiment of the present invention may be used as a construction toy. The suction cup toy 6700 may be attached to one or more blocks 6702, 6704, 6706 using suction cups 110 so as to act as a mortar holding the blocks 6702, 6704, 6706 together. In this way, complex structures may be built by combining a number of suction cup toys 6700 and blocks 6702, 6704, 6706.

Similarly, a suction cup toy 6700 may be used to affix other objects together. For example, one side of a suction cup toy could be attached to a plate while a second side of the toy simultaneously is attached to the tray on a high chair. In this way, the suction cup toy restrains the plate from moving such that the plate will remain adjacent to the high chair while a child is eating.

It is understood that the preceding is merely a detailed description of some examples and embodiments of the present invention and that numerous changes to the disclosed embodiments can be made in accordance with the disclosure made herein without departing from the spirit or scope of the invention. The preceding description, therefore, is not meant to limit the scope of the invention but to provide sufficient disclosure to one of ordinary skill in the art to practice the invention without undue burden.

What is claimed is:

1. A suction cup toy adapted to removably attach to a nonporous surface and adapted for easy removal from the surface once attached, the suction cup toy comprising:

a substantially planar sheet comprising a flexible, chewable material having a front side, a back side opposite the front side, and a perimeter section;

a first array of suction cups disposed on either of the front side or the back side, wherein each suction cup in the first array extends perpendicularly away from the sheet and is adapted to removably attach to the surface; and a means for holding the toy so as to detach the suction cups of the first array from the surface, wherein the means is selected from a group consisting of:

a lip on the perimeter surface of the planar sheet wherein the lip protrudes perpendicular to the sheet and extends a distance away from both the front side and the back side;

a first textured portion disposed on the back side with a first protrusion extending away from the back side and a second textured portion disposed on the front side opposite the first textured portion with a second protrusion extending away from the front side;

a passageway extending through the sheet from the back side to the front side, wherein the passageway is adapted to allow a child to grasp and place a lifting force on the toy; and a portion of the first array wherein a distance between adjacent ones of the suction cups in the portion of the first array is increased so as to allow a child to insert one or more fingers between the adjacent ones of the suction cups;

wherein the surface further comprises two or more holes extending through the sheet from the back side to the front side that are adapted to allow the passage of air.

2. The suction cup toy of claim 1, further comprising at least a second array of suction cups disposed on either the front side or the back side such that the second array is opposite the first array, wherein each suction cup in the second array extends perpendicularly away from the sheet and is adapted to removably attach to the surface.

3. The suction cup toy of claim 2, wherein the suction cups in the first array are of substantially equivalent dimensions to the suction cups in the second array and the number of suction cups in the first array is greater than the number of suction cups in the second array, such that the force required to remove the first array from the surface is greater than the force required to remove the second array from the surface.

4. The suction cup toy of claim 3, wherein the first array is arranged in a first regular pattern, the second array is arranged in a second regular pattern, and the first and second regular patterns are selected from a group comprising a square, a rectangle, a triangle, a circle, a rhomboid, and an ellipse.

5. The suction cup toy of claim 2, wherein each one of the suction cups in the second array is located opposite a respective one of the suction cups in the first array.

6. The suction cup toy of claim 2, wherein each of the suction cups in the first array is located on a first axis, each of the suction cups in the second array is located on a second axis, and the first axis is different from the second axis.

7. The suction cup toy of claim 1, wherein each suction cup in the first array comprises a head with a head radius and a base with a base radius and wherein the first array is arranged to optimally cover either the back side or the front side such that for each pair of adjacent suction cups comprising a first suction cup and a second suction cup, the base of the first suction cup is spaced apart from the base of the second suction cup by a distance that is substantially equal to two times the difference of the head radius and the base radius.

8. The suction cup toy of claim 1, wherein a central portion of either the front side or the back side is substantially covered by texturing comprising a third protrusion extending away from the sheet.

9. The suction cup toy of claim 8, wherein the third protrusion is a plurality of third protrusions and the plurality of third protrusions is arranged in a regular pattern.

10. The suction cup toy of claim 1, wherein the two or more holes is a plurality of holes and each of the plurality of holes is adjacent to one of the suction cups in the first array.

11. The suction cup toy of claim 1, wherein the flexible material comprises medical grade silicone.

12. The suction cup toy of claim 1, wherein the sheet is in the form of one of the group comprising an animal, a letter, and a number.

13. The suction cup toy of claim 1, wherein the sheet is a first color and the first array is a second color.

14. A suction cup toy adapted to removably attach to a nonporous surface and adapted for easy removal from the surface once attached, the toy comprising:

a tube comprising a flexible, chewable material having a surface comprising a front section, a back section opposite the front section, an exterior section, and an interior section opposite the exterior section, wherein the front section and back section are substantially orthogonal to the exterior section and the interior section and the tube is toroidal;

a first array of suction cups disposed on the back section, wherein each suction cup in the first array extends perpendicularly away from the back section and is adapted to removably attach to the surface;

a second array of suction cups disposed on the front section, wherein each suction cup in the second array extends perpendicularly away from the front section and is adapted to removably attach to the surface; and a third array of suction cups disposed on the exterior section, wherein each suction cup in the third array extends perpendicularly away from the exterior section and is adapted to removably attach to the surface;

wherein the suction cups in the first array are of substantially equivalent dimensions to the suction cups in the second array and the number of suction cups in the first array is greater than the number of suction cups in the second array, such that the force required to remove the first array from the surface is greater than the force required to remove the second array from the surface.

15. The suction cup toy of claim 14, wherein the tube is a toroidal ring.

16. The suction cup toy of claim 14, wherein a portion of the tube has a texture including a protrusion extending away from the tube.

17. The suction cup toy of claim 14, wherein each suction cup in the third array comprises a head with a head radius and a base with a base radius and wherein the third array is arranged to optimally cover the exterior section such that for each pair of adjacent suction cups comprising a first suction cup and a second suction cup, the base of the first suction cup is spaced apart from the base of the second suction cup by a distance that is substantially equal to two times the difference of the head radius and the base radius.

18. The suction cup toy of claim 14, wherein the suction cup toy comprises a holding means adapted to enable the suction cups of the first array to be easily detached from the surface, the means selected from the group consisting of:

a protrusion connected to the tube and extending perpendicular to the tube, the protrusion including a textured portion, and one or more gaps, wherein each of the one or more gaps is located between adjacent ones of the suction cups in the first array and are adapted to enable a child's finger to fit in the one or more gaps.

19. The suction cup toy of claim 18, wherein each suction cup in the first array extends a distance away from the tube, wherein the distance is greater than the thickness of the child's finger.

* * * * *